United States Patent [19]

Ishii et al.

[11] Patent Number: 4,944,223

[45] Date of Patent: Jul. 31, 1990

[54] MECHANISM FOR CONTINUOUSLY SUPPLYING DAMPENING MEDIUM IN OFFSET PRINTING MACHINE

[75] Inventors: Koji Ishii; Naoki Ikeda, both of Fuchu, Japan

[73] Assignee: Ryobi Ltd., Hiroshima, Japan

[21] Appl. No.: 352,236

[22] Filed: May 15, 1989

[30] Foreign Application Priority Data

May 16, 1988 [JP] Japan ..... 63-64850[U]

[51] Int. Cl.[5] ..... B41L 23/00

[52] U.S. Cl. ..... 101/148

[58] Field of Search ..... 101/148, 147

[56] References Cited

U.S. PATENT DOCUMENTS 3,688,694 9/1972 Preuss et al. ..... 101/148
3,911,815 10/1975 Banfer ..... 101/148
4,351,236 9/1982 Beisel et al. .

FOREIGN PATENT DOCUMENTS 107837 5/1982 Japan ..... 101/148
1197508 7/1970 United Kingdom ..... 101/148

*Primary Examiner*—Edgar S. Burr
*Assistant Examiner*—Ren Yan
*Attorney, Agent, or Firm*—Sughrue, Mion, Zinn, Macpeak & Seas

[57] ABSTRACT

A mechanism for continuously supplying a dampening medium in an offset printing machine is disclosed. The mechanism includes a dampening medium applicator roller in rotational contact with a master plate on a master cylinder, a dampening medium transfer roller in rotational contact with the applicator roller, a dampening medium distributor roller in rotational contact with the transfer roller, a dipping roller in rotational contact with the distributor roller, and a metering roller in contact with the dipping roller. The applicator roller and the transfer roller have their outer peripheral surfaces provided with elastic material layers.

5 Claims, 2 Drawing Sheets

MECHANISM FOR CONTINUOUSLY SUPPLYING DAMPENING MEDIUM IN OFFSET PRINTING MACHINE

BACKGROUND OF THE INVENTION

The present invention relates to a mechanism for continuously supplying a dampening medium or solution to a print master plate mounted over a plate cylinder in an offset printing machine.

One conventional mechanism for continuously supplying a dampening medium is illustrated in FIG. 1. In the conventional arrangement, there are provided an inking system A, a dampening system B, and a roller connecting and disconnecting mechanism C. The inking system A includes an ink transfer roller 22 and ink applicator rollers 14, 14' in contact with a master plate (not shown) disposed over a plate cylinder 7.

In the dampening system B, a dampening medium is contained in a dampening medium tank or fountain 1 with a dipping roller 3 placed therein. While the amount of the dampening medium supplied from the tank 1 is being regulated by a metering roller 2 held in rolling contact with the dipping roller 3, the dampening medium supplied from the tank 1 is transferred from the dipping roller 3 to a dampening medium distributor roller 4 which is movable into and out of contact with a dampening medium transfer roller 5. The dampening medium then is fed from the dampening medium distributor roller 4 through the dampening medium transfer roller 5 to an applicator roller 6. By bringing the applicator roller 6 into contact with a plate cylinder 7, the dampening medium on the applicator roller 6 is coated on the master plate. At the same time, ink which has been transferred from the inking system A through an ink distributor roller or an intermediate roller 15, which belongs to the mechanism C, to the applicator roller 6 also is applied to the master plate. The illustrated dampening system is disclosed in Japanese Patent Application Kokai No. 55-57464.

The dampening medium applicator roller 6 is made of a resilient material such as rubber for mixing the dampening medium with the ink which has been transferred or applied to the applicator roller 6. With respect to the rollers of the dampening unit A positioned upstream of the applicator roller 6, several rollers are provided with a hydrophilic metal layer such as a plated chromium, layer at outer peripheral surfaces thereof, and the remaining rollers of the dampening system A are provided with an elastic layer such as rubber, and these two kinds of layers are provided alternately with respect to the neighboring rollers. More specifically, the transfer roller 5 positioned immediately upstream of the applicator roller 6 is provided with the hydrophilic metal layer, and the distributer roller 4 positioned immediately upstream of the roller 5 is provided with the elastic layer. Furthermore, the dipping roller 3 positioned immediately upstream of the roller 4 is provided with the hydrophilic metal layer, and the metering roller 2 positioned adjacent to the roller 3 is provided with the elastic layer.

The dampening medium transfer roller 5, which is coated with the hydrophilic metal layer, must remain hydrophilic at all times during a printing process in order to provide a uniform supply of the dampening medium to the master plate. Therefore, it is necessary to avoid an irregular dampening medium supply which would otherwise be caused by ink applied to the roller 5.

In this connection, ink adhesion to the dampening medium transfer roller 5 must be obviated during an inoperative state of the printing machine or even during an operative state thereof. For this reason, when the distributor roller 4 is displaced out of contact with the transfer roller 5 and hence no dampening medium is supplied to the transfer roller 5 irrespective of whether the printing press is in operation or not, the transfer roller 5 and the applicator roller 6 have to be separated from each other. Only after the distributor roller 4 is brought into contact with the transfer roller 6 to supply the dampening medium to the transfer roller 5 are, the transfer roller 5 and the applicator roller 6 held against each other, thus preventing any ink from being applied to the transfer roller 5.

Therefore, in such conventional arrangement, complex roller contacting and separating mechanism is required to effect such roller movements. In addition, even if the transfer roller 5 is moved into contact with the applicator roller 6 after the dampening medium has been supplied to the transfer roller 5, ink coated on the original plate on the plate cylinder 7 in a printing process may be applied through the elastic applicator roller 6 to the transfer roller 5. When this happens, the printing process must be interrupted, and the transfer roller 5 must be cleaned. Accordingly, the transfer roller 5 requires special care to make itself operable normally, and the cleaning of the transfer roller 5 lowers the efficiency of the printing process.

The applicants have proposed a device for connecting and disconnecting a dampening unit B and an inking unit A in an offset printing machine as disclosed in copending U.S. patent application Ser. No. 350,889 filed on May 12, 1989 (corresponding to Japanese patent application No. 63-117969). This proposal is based on another conventional arrangement shown in FIG. 2. According to this device, an ink distributor roller or an intermediate roller 15 is contactable with one of the rollers of the inking unit A. The inking unit A and the dampening unit B are connected to or disconnected from each other by moving the intermediate roller 15 into and out of contact with the dampening medium transfer roller 5 of the dampening unit B. Incidentally, the inking unit A includes an ink fountain roller 13, an ink ductor roller 16, an ink fast roller 17, a first ink delivery roller 18, an ink delivery transfer roller 19, a second ink delivery roller 20, a third ink delivery roller 21, an ink transfer roller 22, and ink applicator rollers 14 14'. The plate cylinder 7 is in rolling contact with a blanket cylinder 8 which is in rolling contact with an impression cylinder 9. A printing sheet 11 is fed between the blanket cylinder 8 and the impression cylinder 9 by means of a sheet feed mechanism 10, and the sheet carrying an output image is discharged onto a sheet table 12.

With this arrangement, ink is transferred by way of the intermediate roller 15 from the inking unit A to the dampening unit B. Therefore, the intermediate roller 15 may be brought into contact with the transfer roller 5, only after a dampening medium has been supplied to the transfer roller 5 and after a printing process has been started, if the roller 5 has the hydrophilic metal layer. Therefore, a desirable output image may not be obtainable promptly at an initial stage of the printing operation in the proposed device.

SUMMARY OF THE INVENTION

In view of the aforesaid problems in the conventional printing machine, it is an object of the present invention to provide an improved mechanism for continuously supplying a dampening medium in an offset printing machine.

Another object of the invention is to provide such an improved mechanism in which operational suspension with respect to a mechanism for connecting and disconnecting the transfer and applicator rollers or suspension of a printing operation is not required for the purpose of cleaning a dampening medium transfer roller.

Still another object of this invention is to provide such a mechanism in which an intermediate roller and the dampening medium transfer roller can be brought into and out of contact with each other irrespective of a supply of dampening medium to the dampening medium transfer roller and even while the printing machine is at an inoperative state.

These and other objects of the invention will be attained by providing a mechanism for continuously supplying a dampening medium in an offset printing machine, the offset printing machine including a plate cylinder for mounting thereon a master plate, and a dampening unit having a dampening medium fountain for applying a dampening medium onto the master plate. The dampening unit has a roller train including a dampening medium applicator roller in rotational contact with the master plate, a dampening medium transfer roller in rotational contact with the applicator roller, and a plurality of rollers bridging the fountain and the dampening medium transfer roller. The dampening medium in the fountain is applied onto the master plate through the roller train. The mechanism includes the dampening medium transfer roller and the dampening medium applicator roller provided with elastic layers at outer peripheral surfaces thereof, and the plurality of rollers being provided with hydrophilic metal layers and elastic layers alternately arranged at outer peripheral surfaces thereof with respect to the direction of the roller train. The plurality of rollers includes a dampening medium distributor roller, a dipping roller, and a metering roller.

Since the applicator roller and the dampening medium transfer roller are formed of the elastic material, these rollers can retain a mixture of ink and dampening medium, and such a mixture is applied to the master plate disposed over the plate cylinder. To be more specific, before the dampening medium is supplied to these rollers, ink supplied from the inking unit to and coated on an original plate on a plate cylinder is applied onto the dampening medium applicator roller, or ink from the inking unit is applied to the dampening medium transfer roller and the dampening medium applicator roller through the intermediate roller. Thereafter, the dampening medium distributor roller is brought into contact with the dampening medium transfer roller to mix the dampening medium from the distributor roller with the ink applied to the transfer roller and the applicator roller. Therefore, the ink mixed with the dampening medium can be supplied to the original plate on the plate cylinder.

The above and other objects, features, and advantages of the present invention will become more apparent from the following description when taken in conjunction with the accompanying drawings in which a preferred embodiment of the present invention is shown by way of an illustrative example.

DETAILED DESCRIPTION OF THE PREFERRED EMBODIMENT

Figure 1:
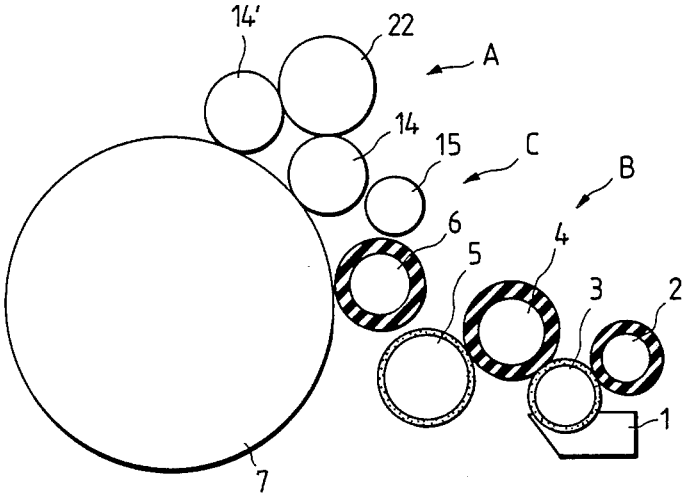
FIG. 1 PRIOR ART
FIG. 1 is a schematic view showing conventional inking and dampening units.
Figure 2:
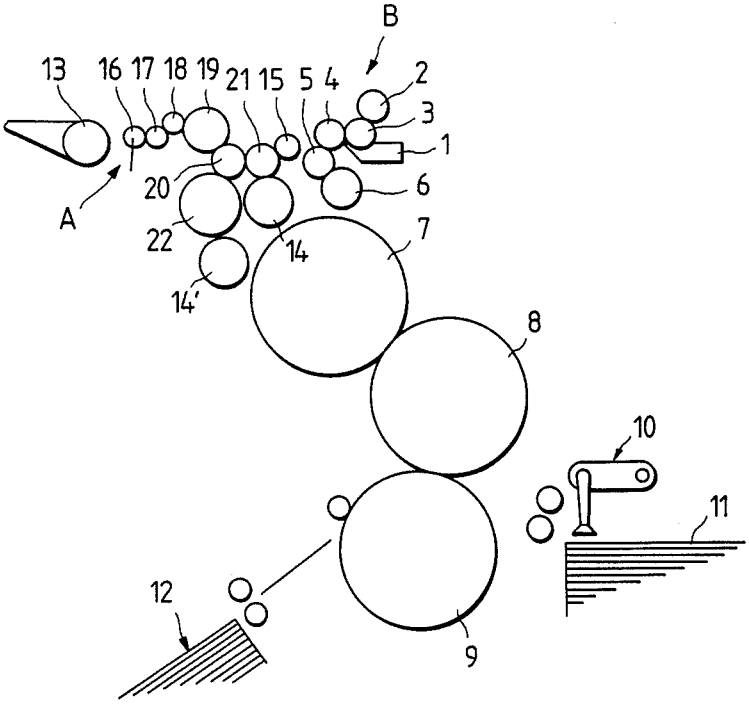
FIG. 2 PRIOR ART
FIG. 2 is a schematic view particularly showing inking and dampening units in another conventional arrangement.
Figure 3:
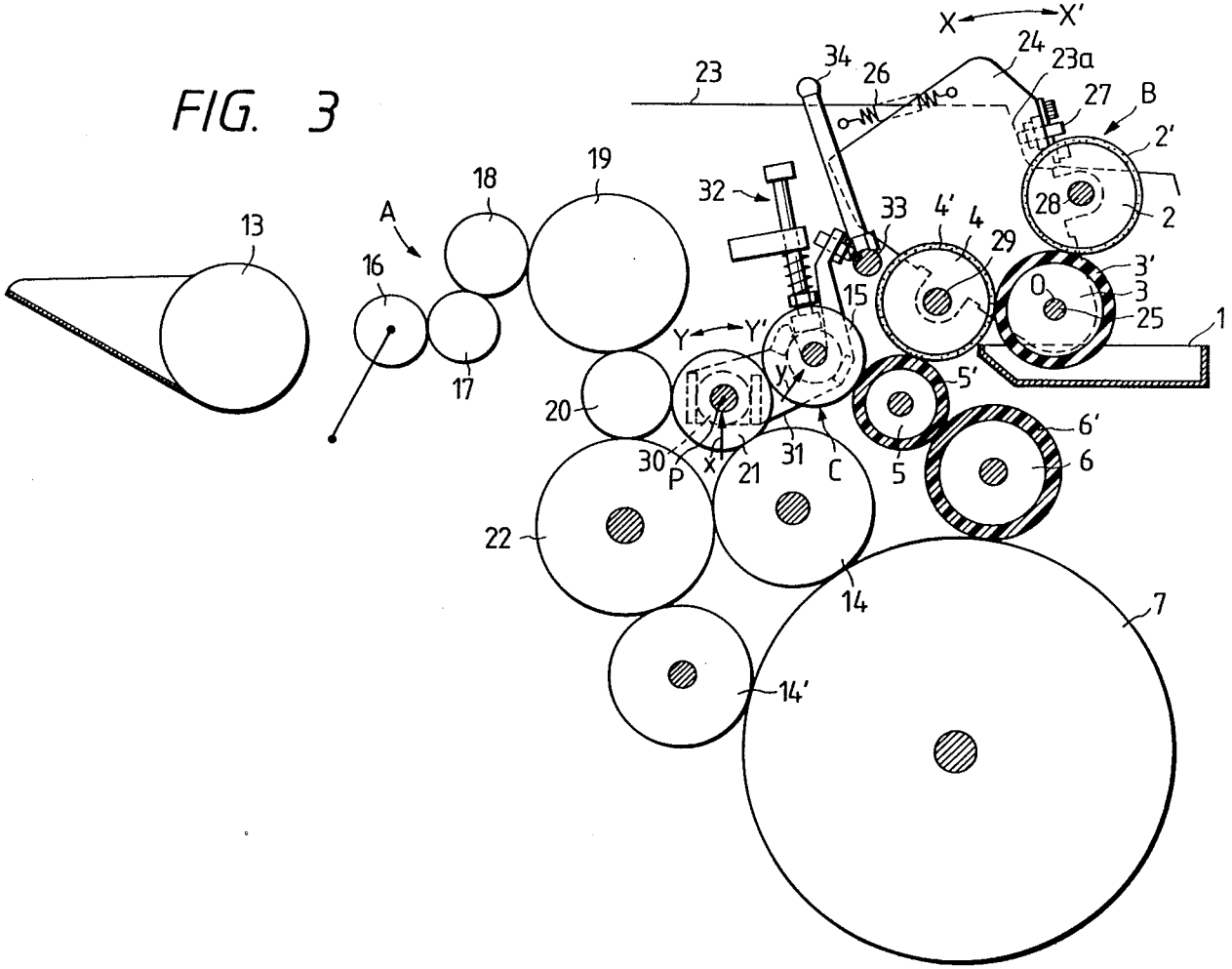
FIG. 3 is a vertical cross-sectional view showing a mechanism for continuously supplying dampening medium in an offset printing machine according to the present invention.

As shown in FIG. 3, an inking unit A is started with an ink fountain roller 13 and ended with ink applicator rollers 14, 14'. More specifically, the inking unit A includes the rollers 13, 14, 14', and an ink ductor roller 16, an ink fast roller 17, a first ink delivery roller 18, an ink delivery transfer roller 19, a second ink delivery roller 20, a third ink delivery roller 21, and an ink transfer roller 22. These rollers of the inking unit A are rotatable in synchronism with operation of an offset printing machine (not shown). The roller train per se is the same as that shown in FIG. 2.

A dampening unit B begins with a dipping roller 3 in a dampening medium tank 1 and ends with a dampening medium applicator roller 6. More specifically, the dampening unit B further includes, between the rollers 3 and 6, a dampening medium distributor roller 4, a dampening medium transfer roller 5, and a metering roller 2. These rollers of the dampening unit B are rotatable in synchronism with operation of the offset printing machine, or by an independent motor (not shown).

The amount of ink supplied from the ink fountain roller 13 can be regulated by the ink ductor roller 16. The amount of a dampening medium supplied from the dampening medium tank 1 can be regulated by adjusting the contacting pressure given between the metering roller 2 and the dipping roller 3, and by bringing the distributor roller 4 into and out of contact with the transfer roller 5 and adjusting the pressure under which the distributor roller 4 is pressed against the transfer roller 5.

According to the illustrated embodiment, two dampening frames 24 are movable pivotally in the directions indicated by the arrows X,X' about a shaft 25 extending between inking frames 23. The shaft 25 is provided coaxially with the axis 0 of the dipping roller 3. The metering roller 2 and the distributor roller 4 are supported rotatably by respective shafts 28,29 extending between the dampening frames 24. Therefore, the rollers 2, 3, and 4 are supported rotatably the dampening frames 24 while the remaining rollers are supported rotatably on the inking frames 23. The frames 24 are biased normally in the direction indicated by the arrow X under the tension of a tension springs 26 having one end connected to the frame 23 and another end connected to the frame 24.

The dampening frames 24 are held in camming engagement with cams (not shown) mounted on the respective inking frames 23. By angularly moving the frames 24 in the direction of the arrow X' against the tensile force of the springs 26, the distributor roller 4 is displaced out of contact with the transfer roller 5. By rotating the cams, the dampening frames 24 are brought out of engagement with the cams to move the distributor roller 4 into contact with the transfer roller 5. Each of the adjustment screws 27 is mounted threadedly on each of the dampening frames 24, and the screw 27 has a tip end abutting against a side surface 23*a* of the inking frame 23. The dampening frames 24 can be swung in the direction indicated by the arrow X or X' by turning the adjustment screw 27 thereby to adjust the pressure under which the distributor roller 4 is held against the transfer roller 5. Such a structure is described in detail in a copending U.S Patent Application Ser. No. 344,578 filed on Apr. 28, 1989 (corresponding to Japanese patent application No. 63-110723)

The printing machine is further provided with, as described below, a device for connecting and disconnecting the dampening unit B and the inking unit A. The device is particularly described in another copending U.S. patent application Ser. No. 350,889 filed on May 12, 1989 (corresponding to Japanese patent application No. 63-117969).

The third ink delivery roller 21 of the inking unit A and the transfer roller 5 of the dampening unit B can be brought into and out of contact with each other by way of an ink distributor roller or an intermediate roller 15. The intermediate roller 15 is mounted rotatably on and between a pair of brackets 31 pivotally supported on the inking frames 23 for angular movement in the directions indicated by the arrows Y,Y' about a pair of pins 30 mounted on the respective frames 23 in coaxial alignment with a rotation axis P of the third ink delivery roller 21. The intermediate roller 15 and the third ink delivery roller 21 are slidable respectively with respect to the brackets 31 in the directions indicated by the arrows x, y. The intermediate roller 15 is urged normally in the direction opposite the direction y by biasing means 32 mounted on the inking frames 23. The intermediate roller 15 can be brought into and out of contact with the transfer roller 5 by pivotally moving the brackets 31 about the pins 30. This pivotal motion of the brackets 31 is provided by abutment of the free ends of the brackets 31 with cam means (not shown) mounted on a detachable shaft 33 which extends between the inking frames 23. The cam means is rotatable about an axis of the shaft 33 upon manipulation of a lever handle 34 provided integrally with the shaft 33.

According to the present invention, the dampening medium applicator roller 6 has an outer peripheral layer 6' and the dampening medium transfer roller 5 has an outer peripheral layer 5', these layers 6', 5' being made of an elastic material such as rubber or soft synthetic resin, for example, soft vinyl chloride, soft urethane, or the like. On the other hand, the distributor roller 4 has an outer peripheral layer 4' and the metering roller 2 has an outer peripheral layer 2', these layers 4',2' being made of a material such as plated chromium. The dipping roller 3 has an outer peripheral layer 3' made of an elastic material such as rubber or the like.

Before the dampening medium is supplied to the transfer roller 5 and the dampening medium applicator roller 6, ink supplied from the inking unit A to and coated on an original plate on the plate cylinder 7 is applied to the transfer roller 5 through the applicator roller 6, or ink from the inking unit A is applied to the transfer roller 5 through the intermediate roller 15. Thereafter, the distributor roller 4 is brought into contact with the transfer roller 5 to mix the dampening medium from the distributor roller 4 with the ink applied to the transfer roller 5 and the applicator roller 6. Since the rollers 5 and 6 are provided with the elastic layers, these layers can a mixture of ink and dampening medium. Therefore, the ink mixed with the dampening medium can be supplied to the original plate on the plate cylinder 7.

Since the transfer roller 5 is not required to be hydrophilic, it is not necessary to bring the transfer roller 5 and the applicator roller 6 into and out of contact with each other. Therefore, a mechanism for operating the applicator roller 6 is simplified.

Further, a printing process can be started even if ink is adhered in advance onto the transfer roller 5. Hence, it is not necessary to interrupt the printing operation for the purpose of cleaning the transfer roller 5.

Furthermore, where the inking unit A and the dampening unit B are brought into and out of contact with each other by moving the intermediate roller 15 relative to either the transfer roller 5 or the applicator roller 6, the intermediate roller 15 can be displaced into or out of contact with rollers 5 or 6 at any time irrespective of the operational phases. For example, the intermediate roller 15 can be moved toward and away from rollers 5 or 6 an inoperative state of the printing machine or during a phase irrespective of whether or not the dampening medium is supplied to rollers 5 or 6.

Although a certain preferred embodiment has been shown and described, it should be understood that many changes and modifications may be made therein without departing from the spirit and scope of the invention.

What is claimed is:

1. In a mechanism for continuously supplying a dampening medium in an offset printing machine, the offset printing machine including a stationary frame, a plate cylinder for mounting thereon a master plate, an inking unit for applying an ink to the master plate, and a dampening unit having a dampening medium fountain for applying a dampening medium onto the master plate, the dampening unit comprising a roller train including a dampening medium applicator roller in rotational contact with the master plate, a dampening medium transfer roller in rotational contact with the applicator roller, and a plurality of rollers bridging the fountain and the dampening medium transfer roller, dampening medium in the fountain being applied onto the master plate through the roller train, the improvement wherein:

the dampening medium transfer roller is rotatably supported by the stationary frame;

the dampening medium transfer roller and the dampening medium applicator roller comprise elastic layers at respective outer peripheral surfaces thereof; and the plurality of rollers have one of a hydrophilic metal layer and an elastic layer at respective outer peripheral surfaces thereof, wherein adjacent ones of said rollers have different outer peripheral surface layers; and means, having first and second positions, for selectively connecting said inking unit and said dampening unit, said inking unit contacting said dampening unit at said first position of said means, for applying dampening medium to said inking unit, and said inking unit being out of contact with said dampening unit at said second position of said means, for applying dampening medium to the master plate only through the dampening medium applicator roller.

2. The mechanism as defined in claim 1, wherein the plurality of rollers comprises a dampening medium distributor roller in rotational contact with the dampening medium transfer roller; a dipping roller disposed within the fountain and in rotational contact with the dampening medium distributor roller, and a metering roller in rotational contact with the dipping roller, the dampening medium distributor roller being provided with the hydrophilic metal layer at its outer peripheral surface, the dipping roller being provided with the elastic layer at its outer peripheral surface, and the metering roller being provided with the hydrophilic metal layer at its outer peripheral surface.

3. The mechanism as defined in claim 2, wherein said means for selectively connecting said inking unit and said dampening unit comprises an intermediate roller selectively contactable with the dampening medium transfer roller.

4. The mechanism as defined in claim 1, said inking unit includes at least one applicator roller, wherein said dampening medium applicator roller is remote from said at least one ink applicator roller, such that said dampening medium applicator roller applies only said dampening medium to said master plate.

5. The mechanism as defined in claim 1, wherein the elasitc layers of the dampening medium transfer roller and the dampening medium applicator have roller equal resiliency.

* * * * *